United States Patent [19]

Kuryla et al.

[11] 4,433,267

[45] Feb. 21, 1984

[54] CRT INTERNAL CONTACTOR POSITIONING MEANS

[75] Inventors: Alan T. Kuryla, Geneva; Carl W. Penird, Waterloo; Peter G. Puhak, Seneca Falls, all of N.Y.

[73] Assignee: North American Philips Consumer Electronics Corp., New York, N.Y.

[21] Appl. No.: 339,920

[22] Filed: Jan. 18, 1982

[51] Int. Cl.[3] ..... H01J 29/06

[52] U.S. Cl. ..... 313/402; 313/407; 313/479; 313/482

[58] Field of Search ..... 313/407, 479, 482, 402

[56] References Cited

U.S. PATENT DOCUMENTS 3,377,493 4/1968 Levin et al. ..... 313/407

4,310,779 1/1982 Penird et al. ..... 313/407

*Primary Examiner*—Palmer C. Demeo

*Attorney, Agent, or Firm*—Thomas A. Briody; Jack Oisher; John C. Fox

[57] ABSTRACT

The invention relates to improved combination means for achieving positive placement of an internal electrical contactor in a cathode ray tube to effect and maintain a definitively oriented connection between an internal magnetic shield and a conductive coating disposed on the interior surface of the funnel portion of the tube envelope. Discrete portions of the shield are modified to form a pair of contactor positioning nubs and a cooperating indentation to contain a portion of the contactor in desired alignment therewith.

8 Claims, 6 Drawing Figures

CRT INTERNAL CONTACTOR POSITIONING MEANS

TECHNICAL FIELD

This invention relates to combination positioning means for maintaining accurate placement of an internal electrical contactor in a cathode ray tube (CRT), and more particularly to the combination of associated means for assuring positive orientation of a clip-type contactor on an internal magnetic shielding member to assure the desired shield-to-funnel connection.

BACKGROUND ART

Cathode ray tubes, of the types employed in color television and allied display applications, are often provided with a magnetic shielding arrangement to protect the tube from numerous stray voltages, currents and magnetic fields, including the earth's magnetic field, which tend to adversely affect the desired performance of the tube. While shielding means externally surrounding the tube have been extensively utilized, it has been found that magnetic shields internally disposed in a spaced manner within the tube envelope provide better shielding effects with a resultant marked improvement in the tube performance. Such internal shielding members are usually formed of a substantially continuous bowl-like sidewall having a substantially full frontal opening and a smaller rear opening defined by the terminal perimeter of a continuous ledge instanding from a transition region between the ledge and the sidewall.

It has been conventional practice to attach a flexible electrical contactor to the rear portion of the shielding member to bridge across and make electrical connection with the conductive coating disposed on the interior surface of the funnel portion of the tube. One means of contactor attachment to the shielding member was by welding which tended to erratically produce splatter. The resultant loose particles therefrom are detrimental to tube operation, such as by blocking apertures in the shadow mask or causing shorts and high voltage arcing.

An improvement in the state of the art was disclosed in U.S. Pat. No. 4,310,779, assigned to the assignee of the present invention, wherein the contactor has a clip-on attachment element which is facilely affixed to a fluting formed in the rear ledge of the shielding member. While this clip-on contactor represents a marked improvement, there have been occasions, such as upon a severe impact shock, when the contactor was shifted to an undesired position. Accordingly, the present invention relates to combination means for preventing shifting of the contactor once it is attached to the shielding member.

SUMMARY OF THE INVENTION

Figure 1:
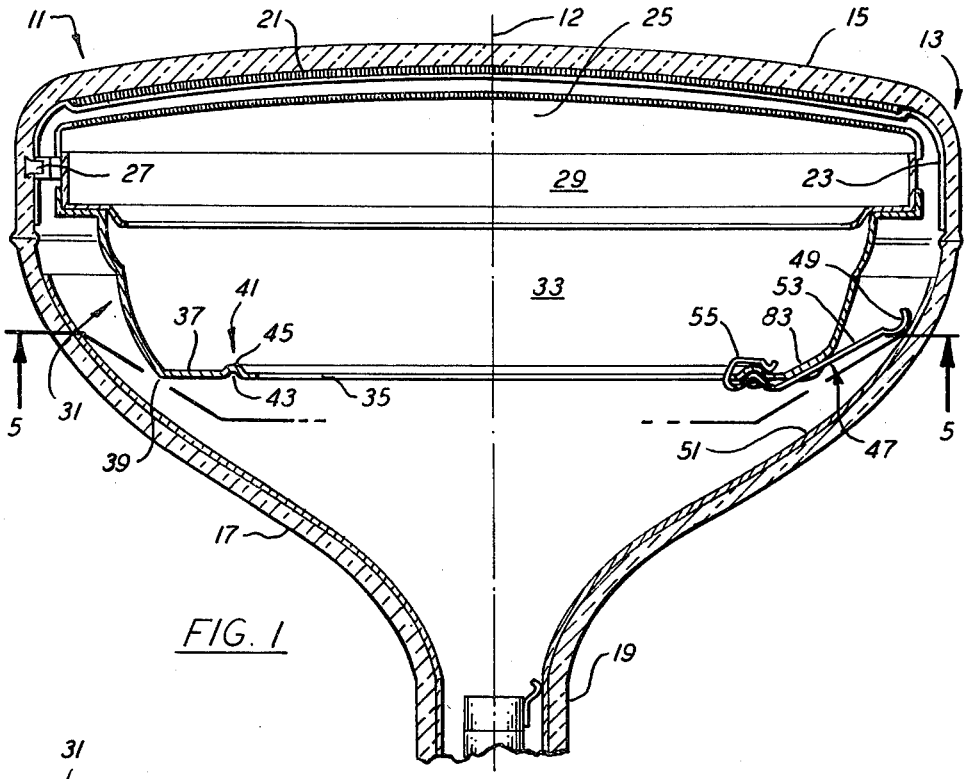
FIG. 1 is a cross-sectional view of a color cathode ray tube including the internal shielding member wherein the invention resides.

The invention is an improvement incorporated into a cathode ray tube having an internal magnetic shielding member spatially positioned within the coated funnel portion thereof. Accordingly, the broad concept of the invention concerns the formation of combination positioning means on the shielding member to maintain accurate placement thereon of a shield-to-funnel electrical contactor.

The shielding member per se, being basically state-of-the-art, is conventionally formed as a substantially continuous bowl-like sidewall having a substantially full frontal opening and a smaller rear opening defined by the terminal perimeter of a continuous ledge instanding toward a central axis from a transition region between the ledge and sidewall. The ledge has a fluting formed therein adjacent the terminal perimeter thereof.

Associated with the shielding member is at least one longitudinal metallic electrical contactor formed as an integration of a clip-type attachment element, an opposed contact element and an intermediate flexural element. The clip-on element is attached to the fluting and the terminal edge of the ledge in a manner to orient the contactor in a position to make electrical connection with the adjacent funnel coating.

Specifically, the preferred embodiment of the invention, being a combination of cooperative means for maintaining accurate placement of the contactor, is comprised of a pair of like spatially related nubs formed of material raised from the fluting of the shielding member at two spaced apart cuts therethrough located on both sides of the contactor location. Closely related therewith is a trough-like retention means formed as an indentation in the ledge and adjacent sidewall portions of the shielding member and extending through the transition region thereof. This indentation is substantially in line with the aforementioned nubs, and is dimensioned to accommodate placement of at least a portion of the flexural element of the contactor therein.

In greater detail, the structural aspects of the nubs are resultant from the two cuts in the fluting which are effected in substantially parallel relationship substantially transversely across the fluting. As such, the cuts have opposed distal sides and adjacent proximal sides defining a section of isolated fluting therebetween. This intermediate isolated section is formed to have greater transverse dimensions than the adjacent fluting on either side thereof. The two areas of fluting material contiguous to the respective distal sides are formed as two louver-shaped nubs having like open facing regions of substantially arcuate contour. Being so formed, the open facing regions of such nub provide two contact areas for each of the opposed side portions of the clip-like contactor attachment element.

In accordance with the preferred embodiment of the invention, the associated trough-like retention indentation is formed to have a substantially planar bottom portion, and evidences a width dimension substantially similar to that of the contactor flexural element. The opposed side portions are formed to slope outward from the bottom portion. The indentation is oriented to slope inward from the ledge surface through the ledge-sidewall transition region of the shielding member to open on the sidewall thereof. The bottom portion has an angle of slope in keeping with the desired general angular orientation of the related contactor.

DESCRIPTION OF THE PREFERRED EMBODIMENT

With reference to the drawings, there are shown internally-oriented combination means for achieving and maintaining accurate placement of at least one CRT shield-to-funnel electrical connector.

The cathode ray tube 11, illustrated in FIG. 1, is an exemplary color CRT having a longitudinal axis 12 therethrough, and embodying an envelope 13 comprised of an integration of viewing panel 15, funnel 17 and neck 19 portions. Adhered to the inner surface of the viewing panel 15 is a patterned cathodoluminescent screen 21 formed of a multitude of discrete areas of color-emitting phosphor materials. A thin metallized film 23, such as aluminum, is usually applied over the interior surface of the screen and a portion of the sidewall area of the panel.

A multi-opening structure or shadow mask member 25 is spatially related to the patterned screen 21; such being predeterminately positioned within the viewing panel 15 by a plurality of stud-like mask supporting members 27 partially embedded in the panel sidewall in spaced-apart orientation.

Securely attached to the rear portion of the mask frame 29 is an inner-shield or internal magnetic shielding member 31. This structure, formed of thin metal, such as cold rolled steel, is shaped to evidence a continuous contoured bowl-like sidewall enclosure 33 having a substantially full frontal opening and a smaller rear opening therein. This rear opening is defined by the terminal perimeter 35 of a continuous instanding ledge 37 extending inward, toward the axis 12, from the ledge and sidewall transition region 39. As such, the ledge constitutes the rear surrounding border portion of the shielding member.

A narrow fluting 41 is formed in the ledge 37 adjacent to the terminal perimeter 35 thereof. While only a limited area of fluting is utilized for the subsequent attachment and placement of at least one shield-to-funnel contactor, the fluting is usually formed as a continuous shaping extending substantially around the ledge 37 thereby providing strengthening thereto. This fluting may be formed with the open channel 43 thereof facing either forward or rearward from the ledge. In this instance, the open channel faces rearward thereby producing a forward-effected rib-like protrusion 45.

Figure 2:
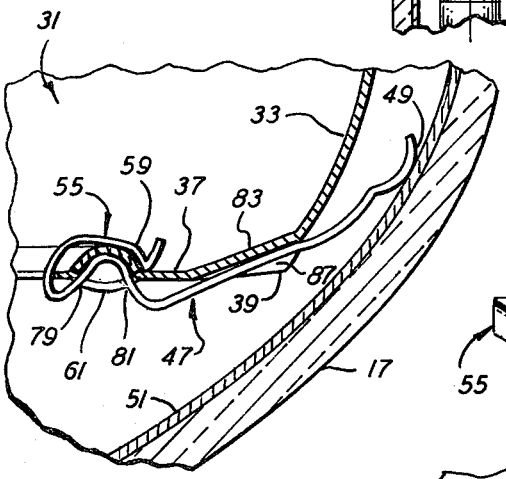
FIG. 2 is an enlarged portion of FIG. 1 detailing the structural elements of the invention.
Figure 3:
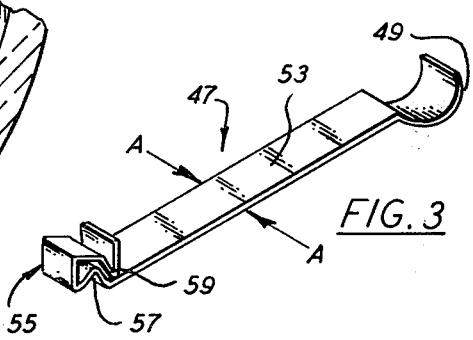
FIG. 3 is an illustration of an exemplary clip-on electrical contactor of the type positionally maintained by the invention.

Associated with the fluting is at least one longitudinal contactor 47, as illustrated in FIGS. 2 and 3, such being fabricated of a resilient metallic material, such as stainless steel. The structure of this contactor is an integration of a terminal contact element 49 fashioned to effect contact with the conductive coating 51 disposed on the interior surface of the funnel 17, an intermediate flexural element 53, and a clip-on attachment element 55 configurated to mate with the fluting 43 formed in the bordering ledge 37 of the magnetic shielding member. Such is disclosed in aforementioned U.S. Pat. No. 4,310,779. In this instance, the configurative shaping of the attachment element 55 provides a protuberance portion 57 which substantially mates with the open channel 43 of the fluting, thereby effecting seating cooperation. An additional and related configurative bend in the attachment element is a fold-back formation providing a substantially opposed hook-like portion 59 which is positioned to concomitantly clasp the rib-like protrusion 45 of the fluting, thereby locking the protuberance 57 in seated placement in the opposed channel 43. Being so affixed, the contactor is oriented to make the desired electrical connection with the funnel-disposed coating 51.

The invention relates to at least one combination means for maintaining positive positioning of the clip-attached connector to prevent sidewise misplacement thereof should the tube be subjected to severe shock impact. As illustrated in FIGS. 2, 4, 5 and 6, the initial part of each combination means is comprised of a pair of like spatially-related nubs 61 and 63 formed of raised fluting material 41 at two spaced apart parallel cuts 65 and 67 made substantially transversely across the fluting on each side of the contactor position. These related cuts have adjacent proximal sides 69 and 70, defining a section of isolated fluting 71 therebetween, and opposed distal sides 72 and 73. The fluting material contiguous to each of the respective distal sides is shaped to provide the two aforementioned louver-shaped nubs 61 and 63 whereof the distal sides 72 and 73 are formed of substantially arcuate contours to provide an open facing region on each nub. As noted in FIGS. 2 and 6, each of the respective arcuately formed distal sides 72 and 73 provides the availability of added structural support in the form of two contact areas 79 and 81 for each of the opposed side portions of the contactor attachment element 55. Double areas of side contact promote improved positioning of the contactor.

Figure 6:
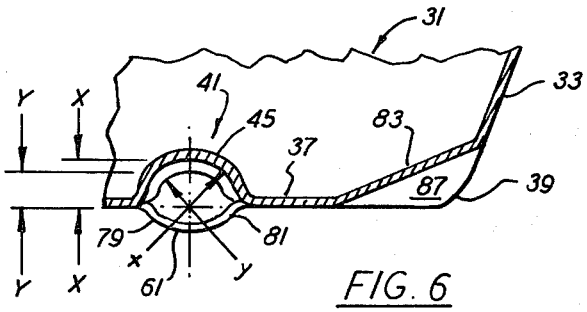
FIG. 6 is an enlarged section of the contactor placement means taken along the line 6—6 of FIG. 5.
Figure 4:
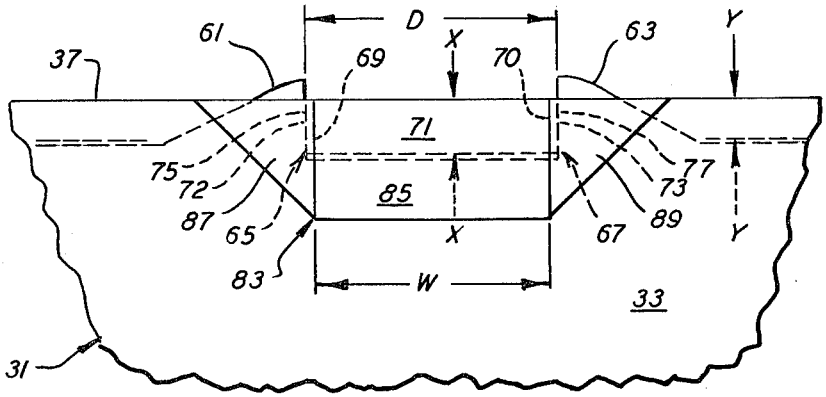
FIG. 4 is an enlarged view of the invention taken along the line 4—4 of FIG. 5.
Figure 5:
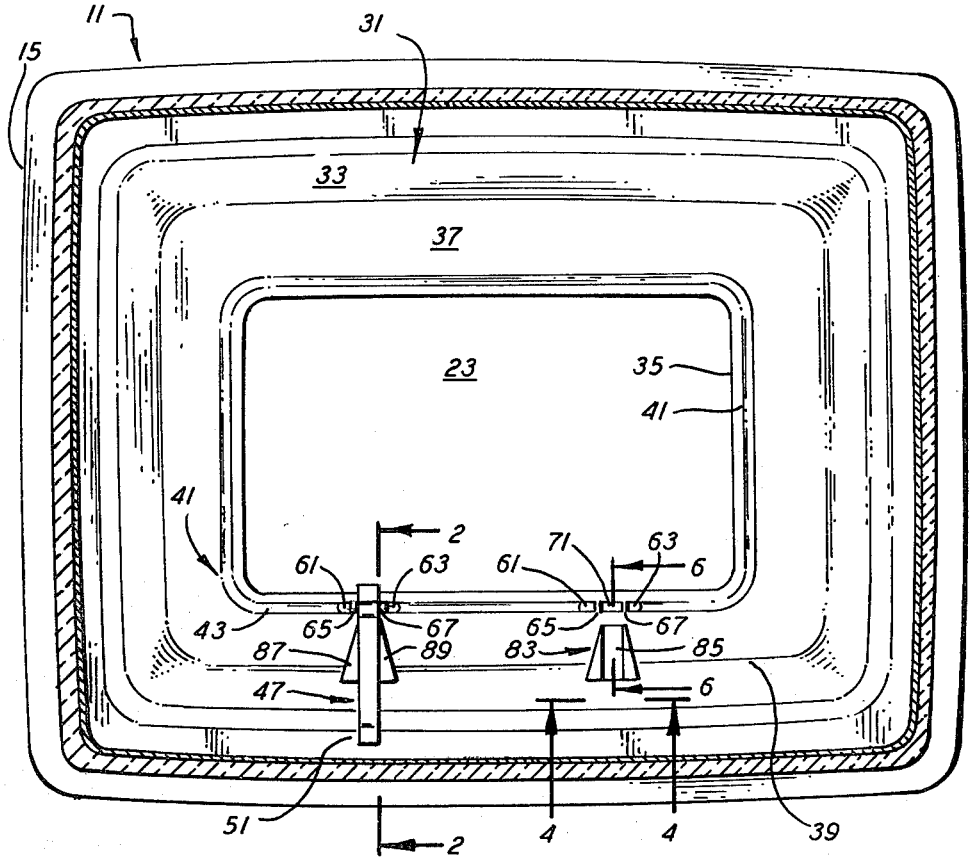
FIG. 5 is a cross-section of the CRT shown in FIG. 1, taken along the line 5—5 thereof, illustrating exemplary orientation of the contactor placement means.

As shown in FIGS. 4 and 6, the intermediate or isolated section of fluting 71, demarcated by cuts 65 and 67, is formed to have transverse dimensioning "X" that is greater than the regular fluting transverse dimensioning "Y" evidenced on either side thereof. For example, such may be demarcated by differential radii "x" and "y" as noted in FIG. 6. This deeper intermediate fluting 71 provides improved seating for the clip-on attachment element 55 of the contactor 47.

The secondary part of each contactor placement combination is a trough-like retention means formed as a slanted, indentation 83 in the ledge 37 and adjacent sidewall 33 portions of the shielding member 31 extending through the transition region 39 thereof. This indentation is formed to contain a portion of the contactor, such being substantially in line with the nubs 61 and 63, and evidencing a substantially planar bottom portion 85 having a width dimension "W" substantially similar to the width dimension "A" of the contactor flexural element 53. As shown, the bottom portion slopes inward from the ledge surface through the ledge sidewall transition region 39 to open on the sidewall. As such, the bottom evidences an angle of slope in keeping with the desired general angular orientation of the contactor flexural element 53. Such is shown in FIGS. 1 and 2.

With reference to FIG. 4, the separation distance "D" between the open faces 75 and 77 of nubs 61 and 63 may be slightly greater than the indentation width dimension "W" to facilitate clip-on attachment of the contactor to the fluting. Additionally, the opposed side portions 87 and 89 of each indentation are preferably sloped outward from the bottom portion 85 to enhance self-centering and facile positioning of the contactor and eliminate drag or frictional side-contact with the flexural element 53 of the contactor.

Fundamentally, in combination interaction, the trough-like indentation is formed to maintain the contactor in the desired aligned position with the cooperating nubs to prevent any sidewise motion or misalignment thereof.

INDUSTRIAL APPLICABILITY

The combination shield-to-funnel contactor positioning means of the invention represents a marked improvement in the manufacture of cathode ray tubes employing internal magnetic shields. The invention provides expeditious means affixing and maintaining positive placement of the electrical contactor on the shield.

We claim:

1. An improvement in a cathode ray tube having a longitudinal axis therethrough and an internal magnetic shielding member spatially positioned within the coated funnel portion thereof, said shielding member being formed as a substantially continuous bowl-like sidewall having a substantially full frontal opening and a smaller rear opening defined by the terminal perimeter of a continuous ledge instanding toward said axis from a transition region between said ledge and said sidewall, said ledge having a fluting formed therein adjacent the terminal perimeter thereof; said shielding member having at least one associated longitudinal metallic contactor formed as an integration of a clip-type attachment element, an opposed contact element and an intermediate flexural element, said attachment element being affixed to said fluting to orient said contactor in a position to make electrical connection with said funnel coating, said improvement being positioned means for maintaining accurate placement of said contactor on said shielding member, said means comprising: the combination of a pair of like spatially-related nubs formed of material raised from said fluting at two spaced apart cuts therethrough located on both sides of said contactor; and trough-like retention means formed as an indentation in said ledge and adjacent sidewall portion of said shielding member extending through the transition region thereof, said retention means being substantially in line with said nubs and dimensioned to accommodate placement of at least a portion of the flexural element of said contactor therein.

2. The contactor positioning means according to claim 1 wherein said fluting cuts are effected in substantially parallel relationship substantially transverse to said fluting, said cuts having adjacent proximal sides and opposed distal sides, said proximal sides defining a section of isolated fluting therebetween; said fluting material contiguous to said distal sides being formed as two louver-shaped nubs having like open facing regions of said nubs.

3. The contactor positioning means according to claim 2 wherein the formed open facing region of each nub is of substantially arcuate contour.

4. The contactor positioning means according to claim 2 wherein the formed open facing regions of each nub provide two contact areas for each of the opposed side portions of said contactor attachment element.

5. The contactor positioning means according to claim 1 wherein said isolated section of fluting exhibits greater transverse dimensions than the adjacent fluting on either side thereof.

6. The contactor positioning means according to claim 1 wherein said trough-like retention means has a substantially planar bottom portion evidencing a width dimension substantially similar to that of the flexural element of said contactor.

7. The contactor positioning means according to claim 6 wherein said trough-like retention means has opposed side portions sloping outward from said bottom portion.

8. The contactor positioning means according to claim 6 wherein the bottom portion of said trough-like retention indentation slopes inward from the ledge surface through said ledge-sidewall transition region to open on said sidewall, said bottom having an angle of slope in keeping with the desired general angular orientation of said contactor.

* * * * *